US006263604B1

(12) United States Patent
Williams

(10) Patent No.: US 6,263,604 B1
(45) Date of Patent: Jul. 24, 2001

(54) HERMETICALLY SCALED PICTURE FRAME

(76) Inventor: Gary Wayne Williams, 2411 Sharon Pl., Evansville, IN (US) 47711

( * ) Notice: Subject to any disclaimer, the term of this patent is extended or adjusted under 35 U.S.C. 154(b) by 0 days.

(21) Appl. No.: 09/400,614

(22) Filed: Sep. 20, 1999

(51) Int. Cl.[7] ..... A47G 1/06
(52) U.S. Cl. ..... 40/718; 40/761
(58) Field of Search ..... 40/718, 761, 124.5, 40/768, 209, 644, 790

(56) References Cited

U.S. PATENT DOCUMENTS

| | | | | |
|---|---|---|---|---|
| 482,237 | * | 9/1892 | Follenius | 40/124.5 |
| 896,753 | * | 8/1908 | Peterson | 40/761 X |
| 1,966,922 | * | 7/1934 | Coleman | 40/124.5 |
| 3,445,151 | * | 5/1969 | Stefanakis | 40/718 X |
| 3,673,722 | * | 7/1972 | Robertson | 40/718 |
| 4,165,573 | * | 8/1979 | Richards | 40/790 X |
| 4,216,936 | * | 8/1980 | DeSelms | 40/768 X |
| 4,399,910 | * | 8/1983 | Gutentag | 40/790 X |
| 4,947,565 | * | 8/1990 | Shadwell . | |
| 5,125,175 | * | 6/1992 | Huff, Jr. | 40/718 |
| 5,787,625 | * | 8/1998 | Yesbick | 40/718 |
| 5,822,895 | * | 10/1998 | Risdal | 40/718 X |

* cited by examiner

*Primary Examiner*—Joanne Silbermann
(74) *Attorney, Agent, or Firm*—Theresa Fritz Camoriano; Camoriano & Associates

(57) ABSTRACT

The present invention, a hermetically sealed picture frame, comprises a frame, a lens and a seal wherein the seal is an elastomeric seal, preferrably an elastomeric o-ring seal. The frame comprises a lens locking groove, a seal groove and mounting framework. The lens snaps into the lens locking groove, compressing the seal in the seal groove between the lens and the frame, providing a hermetic seal for a picture contained between the lens and the frame. The mounting framework is slideable over a mounting base that can be attached to a surface.

3 Claims, 4 Drawing Sheets

HERMETICALLY SCALED PICTURE FRAME

CROSS-REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

1. Field of the Invention

The present invention relates to a picture frame with an improved seal to keep the interior of the frame air tight and impervious to the elements.

2. Background Information

The desire to immortalize deceased loved ones is well recognized.

An example of a picture frame for such a purpose is Morvant, U.S. Pat. No. 4,790,088, Permanent Photographic Memorial Marker, Dec. 13, 1988.

Another example is Doll, U.S. Pat. No. 5,205,059, Display Frame and Protective Container, Apr. 27, 1993.

Both are examples of approaches to a hermetically sealed picture frame. However, there is a need for a simpler hermetically sealed picture frame, one that seals well and is easily replaced by the consumer.

As will be seen from the subsequent description of the preferred embodiments of the present invention, these and other shortcomings of the prior art are overcome by the present invention.

SUMMARY OF THE INVENTION

The present invention, a hermetically sealed picture frame, in the preferred embodiment, comprises a frame, a lens, and a seal wherein the seal is an elastomeric seal, preferrably an elastomeric o-ring seal. The frame comprises a lens locking groove, a seal groove, and mounting framework. The lens snaps into the lens locking groove, compressing the seal in the seal groove between the lens and the frame providing a hermetic seal for a picture or document contained between the lens and the frame. The mounting framework of the frame is slideable over a mounting base that can be attached to a surface such as a wall or a monument including, but not restricted to surfaces of stone, metal, wood, plastic or glass.

DESCRIPTION OF THE PREFERRED EMBODIMENTS

Figure 1:
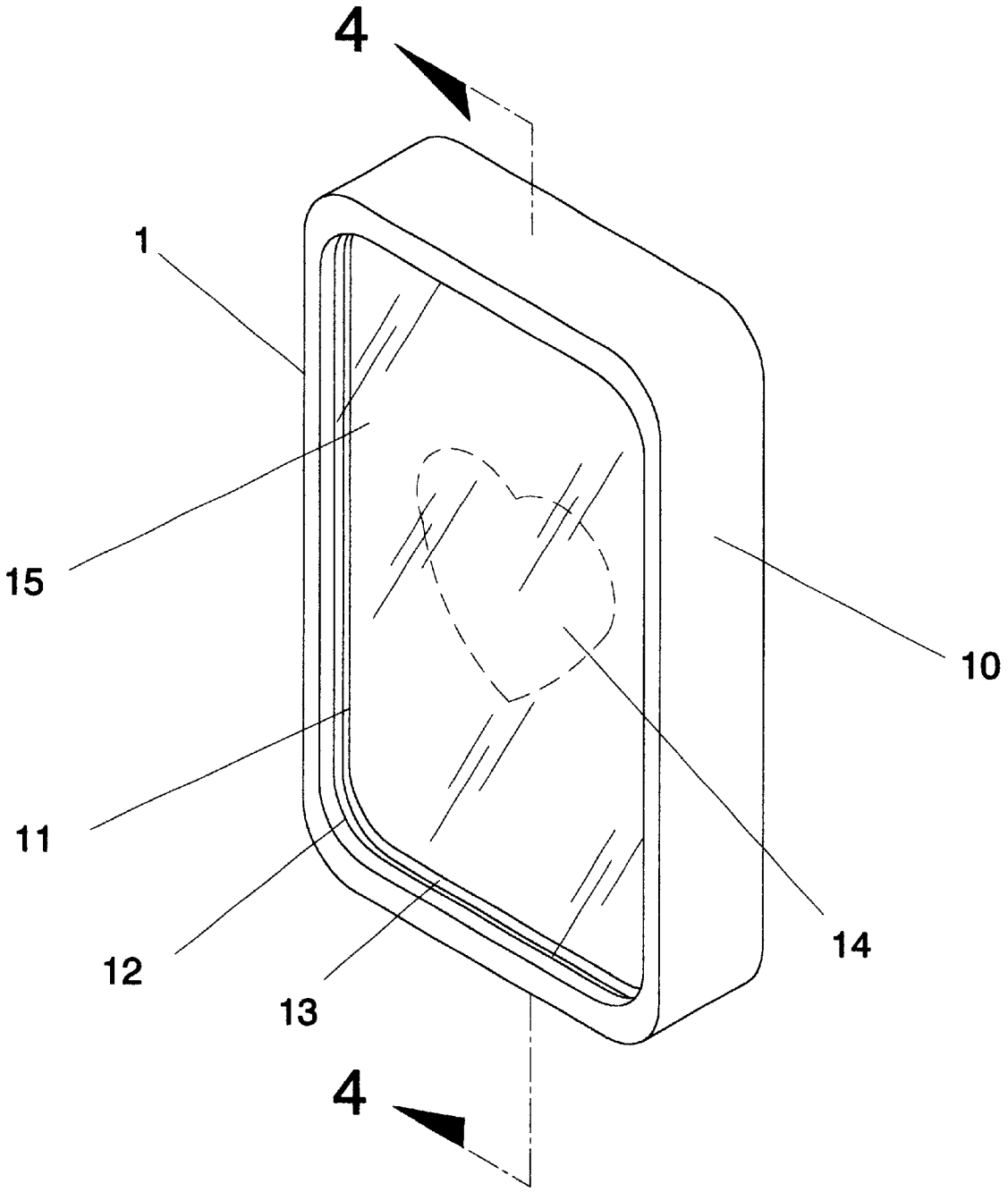
FIG. 1 is a view of the preferred embodiment of the present invention, a hermetically sealed picture frame.
Figure 2:
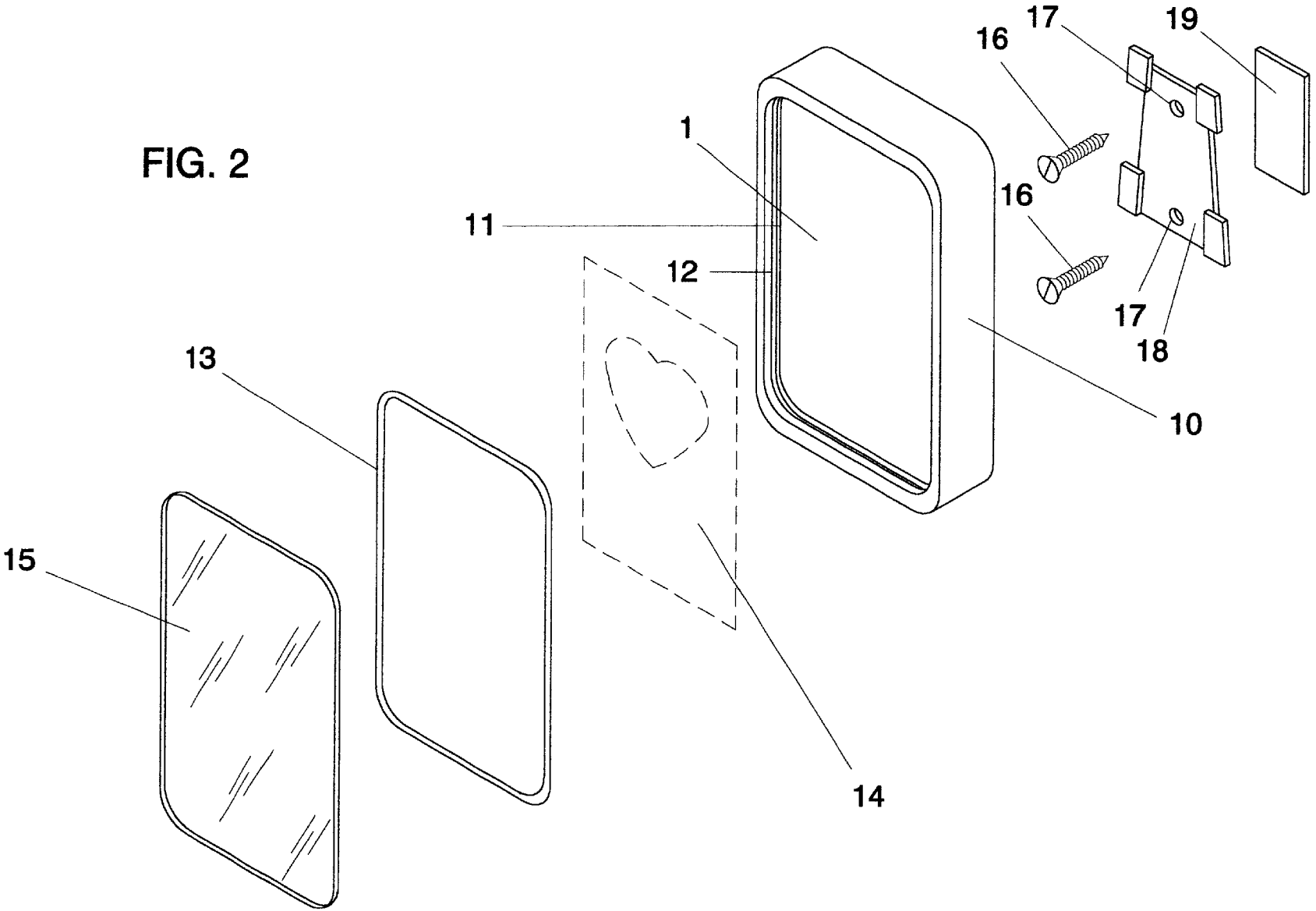
FIG. 2 is an exploded view of the hermetically sealed picture frame.
Figure 3:
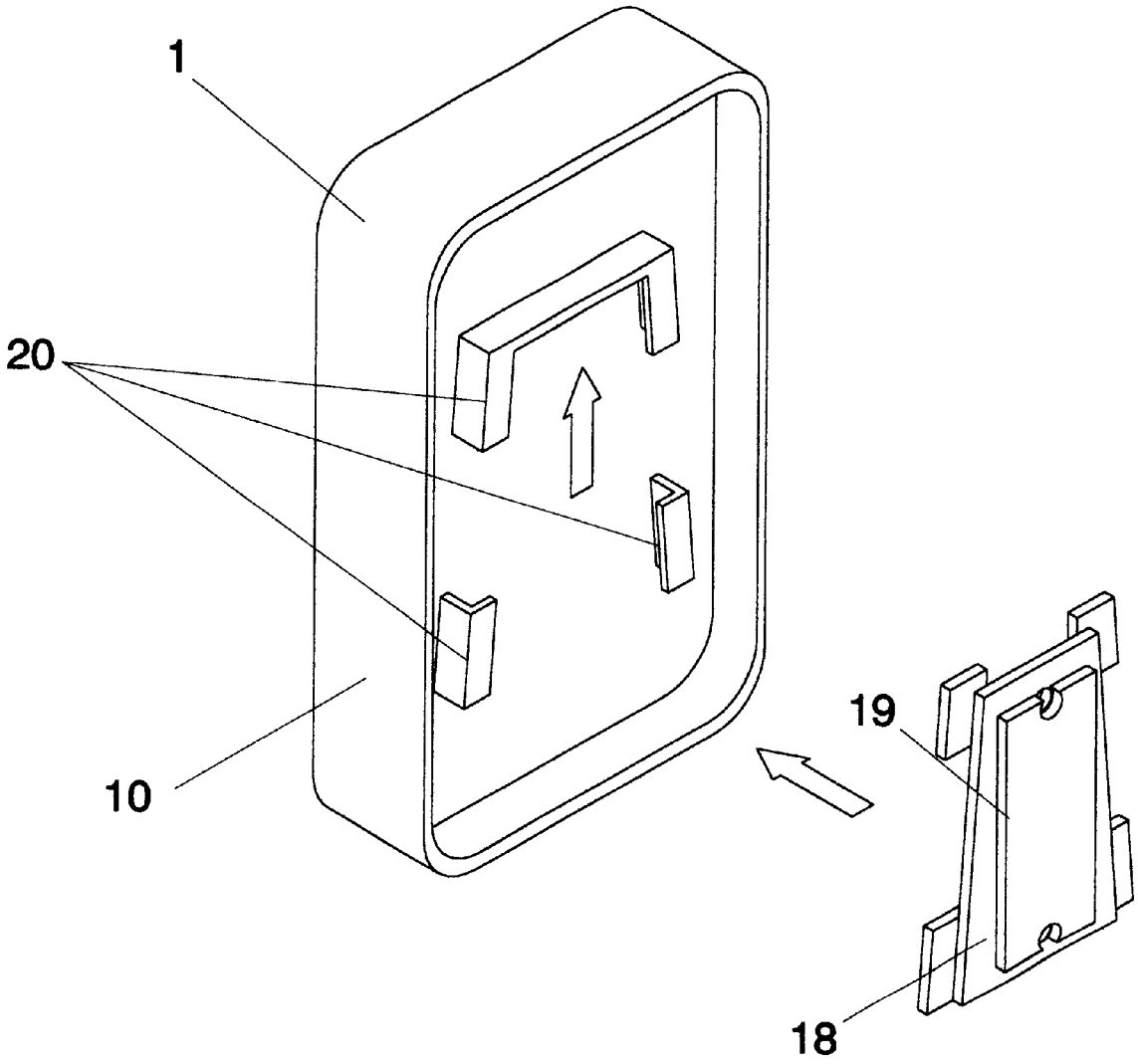
FIG. 3 is a rear view of the present invention with a mounting base.

As shown in FIGS. 1, 2, 3 and 4 the preferred embodiment of the present invention, a hermetically sealed picture frame

1, comprises a frame 10, a seal 13, and a lens 15. The frame 10 comprises a lens locking groove 12, a seal groove 11, and mounting framework 20, said mounting framework 20 attached to said frame 10. An intended purpose of said hermetically sealed picture frame 1 is to enclose and protect a picture 14 from the elements. Said hermetically sealed picture frame 1 is attachable to a flat surface, such as a wall of a building or a monument, by means of sliding the mounting framework 20 of the frame 10 over a mounting base 18. The mounting base 18, in the preferred embodiment, and adhesive pad 19 and mount screw clearance 17. The mounting base 18 can be attached to a surface by means of said adhesive pad 19 or by means of screws 16 through the mount screw clearances 17 or by both the screws 16 and said adhesive pad 19. The mounting base 18 slides into and interlocks with mounting framework 20 of the frame 10 of the hermetically sealed picture frame 1. An advantage of this is that the mounting base is attachable to surfaces including wood, stone, glass or metal using screws and tape in combination or separately. The hermetically sealed picture frame 1 can be removed from the mounting base 18 and replaced as desired with another hermetically sealed picture frame with a different picture, document or license. In the preferred embodiment of the present invention, the mounting base 18 is tapered so as to facilitate installation and removal of the hermetically sealed picture frame I from the mounting base 18.

Figure 4:
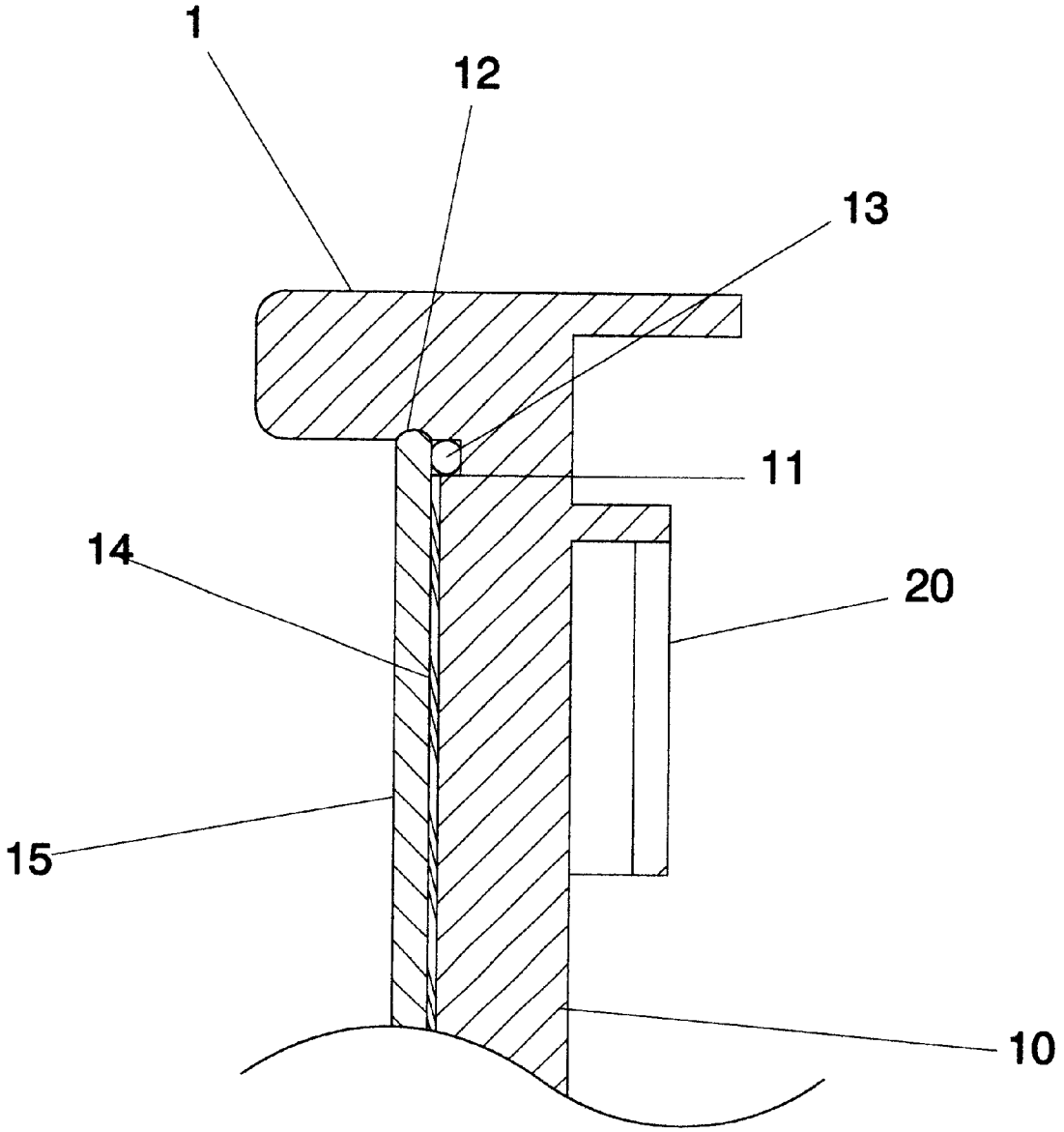
FIG. 4 is a cross section view of the preferred embodiment of the present invention from FIG. 1.

In the preferred embodiment of the present invention, the seal 13 is an o-ring seal. FIG. 4, which is a cross-section view from FIG. 1, shows the lens 15 snapped into place in the lens locking groove 12, compressing the seal 13 in the seal groove 11, said compression of the seal 13 by the lens 15 in place in the lens locking groove providing a hermetic seal for the picture 14 contained between the lens 15 and the frame 10. This is a much simpler sealing arrangement than found in the previously cited prior art.

The frame base structure 1 includes a perimeter and a recessed solid back integral with the perimeter. On the inner surface of the perimeter is the lens locking groove 12, which has an arcuate, concave cross-sectional shape. On the front surface of the solid back adjacent to the perimeter is the seal groove 11, which receives the sealing gasket 13. The outer edge of the lens 15 has an arcuate, convex cross-section which corresponds with the arcuate concave cross-section of the lens locking groove 12, so that the lens 15 can be installed by pressing it into the front of the frame and snapping it into place. When the lens 15 snaps into its locking groove 12, it presses against the sealing gasket 13, forming a seal between the lens 15 and the frame base structure. Projecting from the rear surface of the back of the frame base structure is an inverted U-shaped groove 20, which receives a mounting base 18 with a slide fit. The U-shaped groove 20 is tapered, so that it is wider at the bottom than at the top. The mounting base 18 has a corresponding taper.

While the preferred embodiment is an o-ring in an appropriately sized o-ring groove, a square cut ring in an appropriately sized groove, which is often used for static seals, is an alternative, as would be a seal known in the trade as a quad seal which is a product of Minnesota Rubber Company of 3632 Wooddale Avenue, Minneapolis, Minn.

In the preferred embodiment of the present invention, the preferred material of construction of the lens 15 is a clear plastic such as ACRYLITE OP-2 which is a trademark and product of CYRO INDUSTRIES of Mt. Arlington, N.J. 07856. The preferred materials of construction of the frame 10 are a plastic such as polycarbonate or metal. However, a number of materials will serve the same purpose, including ceramic. The preferred material of construction of the mounting base 18 is polycarbonate although other materials, such as metal, will serve the purpose. The preferred material of construction of the seal is an elastomeric material such as buna-n rubber.

Although the description above contains many specificities, these should not be construed as limiting the scope of the invention but as merely providing illustrations of some of the presently preferred embodiments of the present invention.

For example, in the preferred embodiment of the present invention, an o-ring seal is used in an o-ring groove. However, a square cut seal in an appropriate groove can be made to work.

Also, the picture 14 can be a photograph, drawing, or a document such as, but not restricted to, an instruction sheet, license or a historical document.

Thus the scope of the invention should be determined by the appended claims and their legal equivalents, rather than by the examples given.

I claim:

1. A hermetically sealed frame, comprising:

a base structure, including a perimeter, defining a front, back, outer surface and inner surface and a recessed solid back integral with said perimeter;

a sealing gasket; and a lens;

wherein the inner surface of said perimeter, forward of said solid back, defines a lens locking groove which receives said lens with a snap fit, and wherein said base structure defines a recess which receives said sealing gasket, so that, when said lens is snap fit into its locking groove it presses against said sealing gasket, forming a seal between said lens and said base structure.

2. A hermetically sealed frame as recited in claim 1, wherein said locking groove has an arcuate, concave cross-section, and wherein the outer edge of said lens has a corresponding arcuate convex cross-section.

3. A hermetically sealed frame as recited in claim 2, and further comprising an inverted U-shaped groove projecting from the rear surface of the solid back, and a mounting member which slides into said U-shaped groove.

* * * * *

UNITED STATES PATENT AND TRADEMARK OFFICE

CERTIFICATE OF CORRECTION

PATENT NO. : 6,263,604 B1
DATED : July 24, 2001
INVENTOR(S) : Gary Wayne Williams It is certified that error appears in the above-identified patent and that said Letters Patent is hereby corrected as shown below:

Title page,
Title, change "HERMETICALLY SCALED PICTURE FRAME" to read -- HERMETICALLY SEALED PICTURE FRAME --.

Signed and Sealed this

Twenty-ninth Day of January, 2002

*Attest:*

*Attesting Officer*

JAMES E. ROGAN
*Director of the United States Patent and Trademark Office*